US006547346B2

(12) United States Patent
Topper et al.

(10) Patent No.: US 6,547,346 B2
(45) Date of Patent: Apr. 15, 2003

(54) DIPPING CABINET WITH IMPROVED SERVICE DOOR

(75) Inventors: Robert T. Topper, Heber Springs, AR (US); William E. Zellner, Conway, AR (US)

(73) Assignee: Tyler Refrigeration, Niles, MI (US)

( * ) Notice: Subject to any disclaimer, the term of this patent is extended or adjusted under 35 U.S.C. 154(b) by 0 days.

(21) Appl. No.: 09/745,054

(22) Filed: Dec. 20, 2000

(65) Prior Publication Data

US 2002/0074906 A1 Jun. 20, 2002

Related U.S. Application Data

(60) Provisional application No. 60/237,279, filed on Oct. 2, 2000.

(51) Int. Cl.[7] ..... A47F 3/04
(52) U.S. Cl. ..... 312/116; 312/292
(58) Field of Search ..... 312/114, 116, 312/138.1, 139, 401, 405, 319.8, 319.2, 292

(56) References Cited

U.S. PATENT DOCUMENTS

| | | | | | |
|---|---|---|---|---|---|
| 2,227,854 | A | * | 1/1941 | Walters | 312/114 |
| 2,880,904 | A | * | 4/1959 | Linthicum | 312/292 X |
| 3,860,306 | A | * | 1/1975 | Kenyon | 312/114 X |
| 5,618,089 | A | * | 4/1997 | Stenemann | 312/116 |
| 5,622,414 | A | * | 4/1997 | Artwohl et al. | 312/116 |
| 5,639,149 | A | * | 6/1997 | Grassmuck | 312/116 |
| 6,241,328 | B1 | * | 6/2001 | Ziff | 312/292 X |

FOREIGN PATENT DOCUMENTS

| | | | | |
|---|---|---|---|---|
| DE | 3105886 | * | 8/1982 | 312/116 |
| DE | 3503340 | * | 8/1986 | 312/116 |
| DE | 3843247 | * | 6/1990 | 312/116 |

* cited by examiner

*Primary Examiner*—James O. Hansen
(74) *Attorney, Agent, or Firm*—William W. Habelt

(57) ABSTRACT

A refrigerated cabinet (10) includes a cabinet base (20) defining an open top compartment having a refrigerated interior for housing a refrigerated product (50) and a canopy (30) disposed atop the refrigerated compartment. A transparent glass window in the front wall of the canopy (30) is extended downwardly to the product fill line within the refrigerated compartment thereby expanding the customer view area. The rear wall of the canopy (30) includes a transparent service door (40) and a framework (42). The service door (40) may be rotated independently of the framework (42) to an open position providing service access to the refrigerated compartment. The service door (40) and the framework (42) may also be rotated together as a unit to a second open position to provide access to the refrigerated compartment for cleaning and sanitizing. A lamp (80) for illuminating the cabinet interior is disposed externally of the canopy (30).

2 Claims, 6 Drawing Sheets

DIPPING CABINET WITH IMPROVED SERVICE DOOR

This application claims benefit of provisional application serial No. 60/237,279, filed Oct. 2, 2000.

BACKGROUND OF THE INVENTION

The present invention relates generally to refrigerated cabinets of the type used in commercial application for housing containers of frozen confection to be hand dipped. More specifically, the present invention relates to an improved canopy for a dipping cabinet.

Typically, refrigerated dipping cabinets are horizontal cabinets having a front wall, a back wall, and end walls, all of the same height. The four walls define an open compartment for housing the containers of frozen confection, to be served, for example not only ice cream, but also frozen yogurt, sherbet, sorbet and the like. The walls are commonly of the "cold wall" type having interior and exterior sheet metal skins surrounding a thermally insulating core wherein refrigerant tubing is mounted to the reverse side of the inner sheet metal skin. Cold refrigerant is circulated through the refrigerant tubing to cool the interior skin, while heat is transferred from the product to the cold interior skin of the surrounding walls by radiation and conduction to ensure a stable stratification of cold, dense air is maintained within the cabinet. This thermal stability, which improves with the depth of the tank, is essential to maintain the proper consistency and quality of the frozen product.

Generally, to comply with safety and health codes, dipping cabinets are provided with a tent-like canopy supported atop the four walls of the cabinet. Customers can view the product through a window provided in the front wall of the canopy on the front, that is customer side, of the cabinet. Additionally, the canopy has a rear wall having a service access on the back side, that is server side, of the cabinet. Generally, these canopies are constructed with a single pane glass front window and a rear lid of a thermally formed clear acrylic or polycarbonate-type plastic sheet. The individual serving the customer accesses the frozen confection for scooping through the service access provided in the rear wall on the server side of the canopy. A cover. typically either a hinged lid or a pair of sliding doors, is provided for closing the service access when access is not being made to the interior of the canopied cabinet.

In low temperature refrigerated cabinets, such as dipping cabinets, the product fill line is customarily several inches below the top edge of the cabinet. This open volume is necessary to provide space for a layer of cold refrigerated air over the top of the frozen product to protect the product from the warm ambient air in the store. However, because the product is recessed somewhat below the top edge of the cabinet, customers can not ready view the product through the front window in the canopy of the cabinet, particularly product stored in the front region of the cabinet interior.

In operation, a certain amount of moist, warm ambient air will inevitably enter the cabinet from the store through the service access when open. Frost formation occurs when this moist, warm air contacts the cold wall on the cabinet interior, particularly on the upper portion of the cabinet bounding the space forming the open volume above the food product. Often, a plurality of detachable frost shields, comprising substantially planar panels, are mounted to the upper interior wall of the cabinet to provide a removal surface on which the frost can collect, rather than collecting directly on the cabinet interior walls. To defrost the cabinet, the frost shields are removed from the cabinet and the frost thereon readily removed typically by contacting the frost with hot water.

SUMMARY OF THE INVENTION

It is an object of the present invention to provide a refrigerated cabinet having an improved canopy.

It is a further object of the present invention to provide a canopy having a rotatable rear wall that has a separate service cover providing access to the cabinet interior.

A refrigerated cabinet is provided having a cabinet base defining an open top compartment having a refrigerated interior for housing a refrigerated product and a canopy disposed atop the refrigerated compartment. The cabinet base has a front wall, a back wall and end walls, the front wall being shorter in height than said back wall. The canopy has a front wall having a transparent window through which the cabinet interior may be viewed, and a back wall having a service door. The service door moveable between a closed position and an open position to provide access to the cabinet interior.

In accordance with the present invention, the back wall of the canopy has a transparent service door and a framework about the service door. A support apparatus operatively associated with the canopy is actionable in a first manner to rotate the service door between an open position and a closed position independently of the framework and is actionable in a second manner to rotate the service door and the framework together as a unit between a closed position and an open position.

BRIEF DESCRIPTION OF THE DRAWINGS

The present invention will be described herein with reference to the drawing wherein.

DETAILED DESCRIPTION OF A PREFERRED EMBODIMENT

Figure 1:
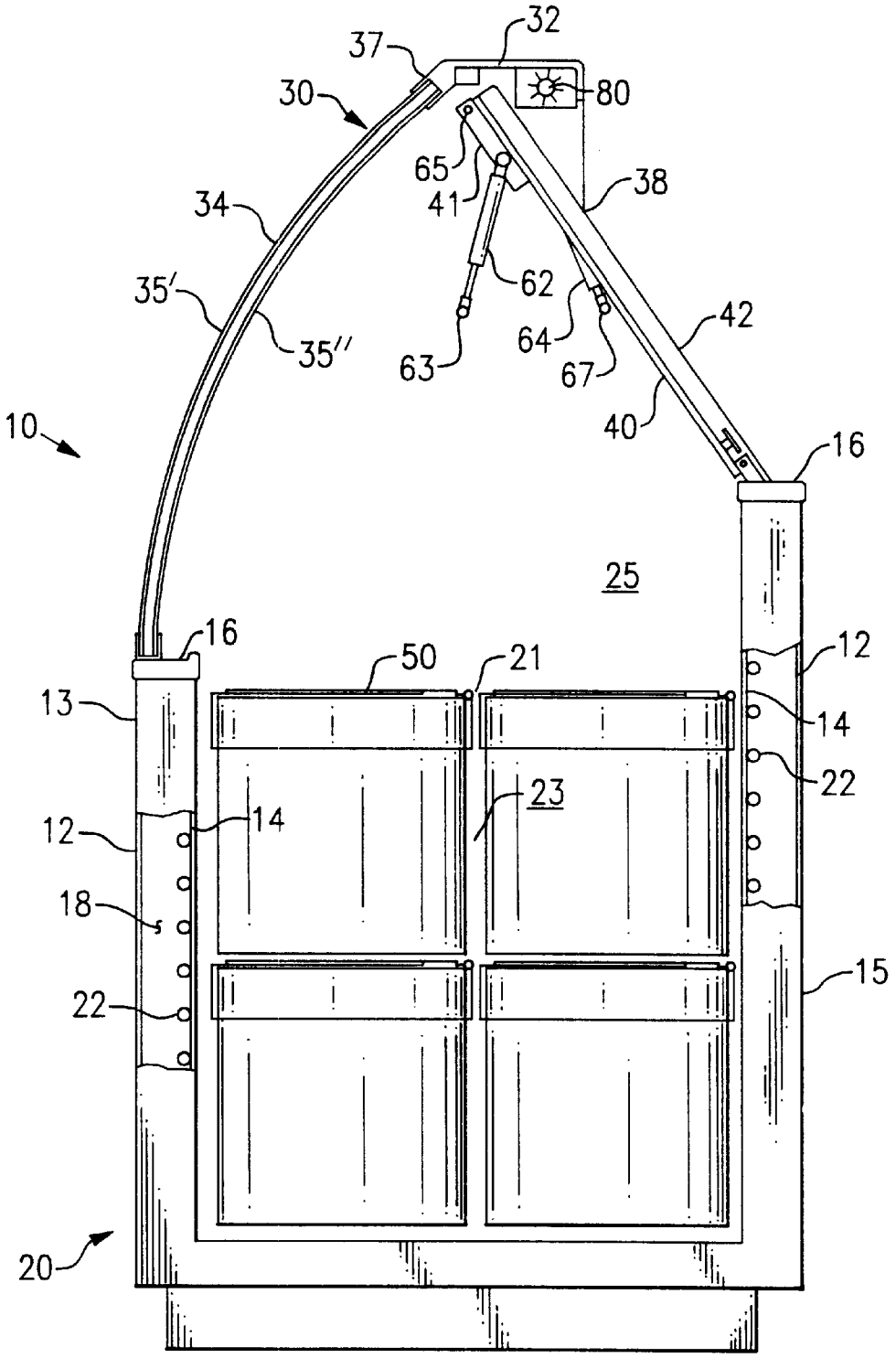
FIG. 1 is a sectional side elevation view of the refrigerated cabinet of the present invention.

The canopied refrigerated cabinet of the present invention will be described herein in a preferred embodiment as an ice cream dipping cabinet. It is to be understood, however, that the canopied refrigerated cabinet of the present invention is generally applicable in various embodiments as refrigerated display cases wherein customer viewing and service access are required. Therefore, it is to be understood that the present invention and the various aspects thereof are not limited to the embodiments illustrated in the drawing.

Referring now to the drawing, the refrigerated cabinet 10 is depicted as an ice cream dipping cabinet. In the depicted embodiment, the cabinet 10 includes a refrigerated base 20 and a canopy 30 supported upon the base 20. The refrigerated base 20 includes an outer shell 12 and an interior refrigerated liner 14 disposed in spaced relationship and capped by a trim member 16. So constructed, the base 20 defines a box-like enclosure having a front wall 13, a rear wall 15 and side walls 17, a floor and an open top. Typically, the walls and floor of the liner 14 are each formed of a metallic, conventionally stainless steel, support sheet with a vinyl layer coated on the observe side thereof. The liner 14 encloses a refrigerated volume 23 in which refrigerated product 50 is stored, usually up to the product fill line 21. In the case of an ice cream dipping cabinet, the refrigerated product 50 may, for example, constitute hard ice cream, frozen yogurt, sorbet, sherbet or other frozen confection.

The outer shell 12 surrounds the liner 14 in spaced relationship about the four side walls and floor thereof. An insulating material 18, for example a foamed in place polyurethane material, disposed in the space between the outer shell 12 and the liner 14 thermally isolates the refrigerated liner 14 from the outer shell 12, which is exposed to room temperature, and adds structure integrity to the cabinet. The liner 14 is cooled in a conventional manner by means of evaporator tubing 22 mounted to or otherwise disposed in heat exchange relationship with the back surface of the liner 14. The evaporator tubing is part of a conventional refrigeration circuit (not shown) wherein compressed refrigerant from a compressor is expanded via a thermal expansion devise, passed through the evaporator tubing, thence through a condenser before returning to the compressor. As the refrigerant, for example R-22, R-404*a* or other commercially available refrigerant, passes through the evaporator tubing, the refrigerant evaporates upon absorbing heat through the liner 14 from the air within the refrigerated volume, thereby cooling the air and the product to maintain a desired temperature. In this manner, a layer of cold air is maintained in the volume 25 above the product 50, which as noted before normally fills the refrigerated enclosure up to the product fill line 21.

The refrigerated base 20 of the cabinet 10 as described hereinbefore and depicted in FIG. 1, is of the conventional "cold wall" construction. For further discussion of this construction, reference may be made to co-pending U.S. patent application Ser. No. 09/639,467. filed Aug. 9, 2000, the entire disclosure of which is hereby incorporated herein by reference. It is to be understood, however, that the particular construction of the base 20 or the particular method of refrigerating the base 20 is not germane to the present invention. For example, the cabinet base 20 may be constructed with cold refrigerated air circulating through an open passage between an outer wall and an inner wall as disclosed in copending U.S. patent applications Ser. No. 09/016,824, filed Jan. 20, 1998, the entire disclosure of which is hereby incorporated herein by reference.

The canopy 30 has a top wall 32, a front wall 34 on the customer side of the cabinet 10, side walls 36, and a rear wall 38 on the service side, i.e. the backside, of the cabinet 10. The top wall 32 is supported upon and extends between the side walls 36 and the front wall 34. The front wall 34 comprises a transparent window 35, made of a transparent material, supported in a frame 37. The window 35 provides a customer view area through which a customer may view the product 50 stored within the refrigerated volume 23. The side walls 36 may be made of stainless steel or other metal, molded plastic, or, if desired, of a support frame and a panel of a transparent material mounted within the frame.

Figure 5:
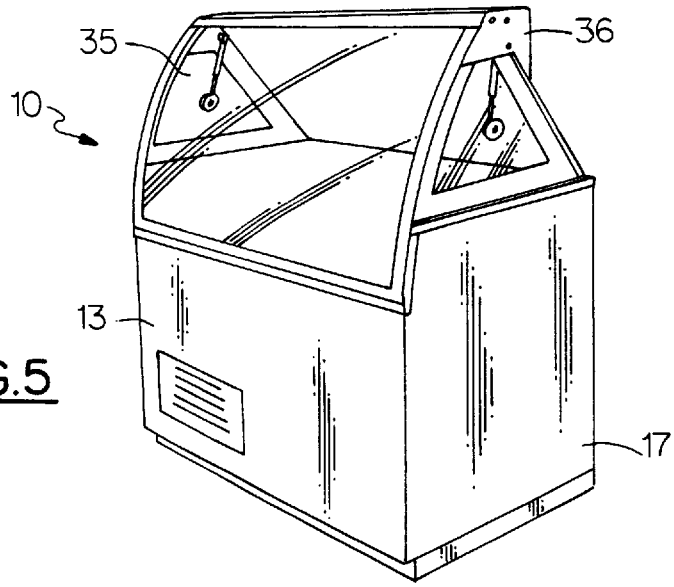
FIG. 5 is a a perspective view of the refrigerated cabinet of the present invention taken generally from the front of the cabinet.
Figure 9:
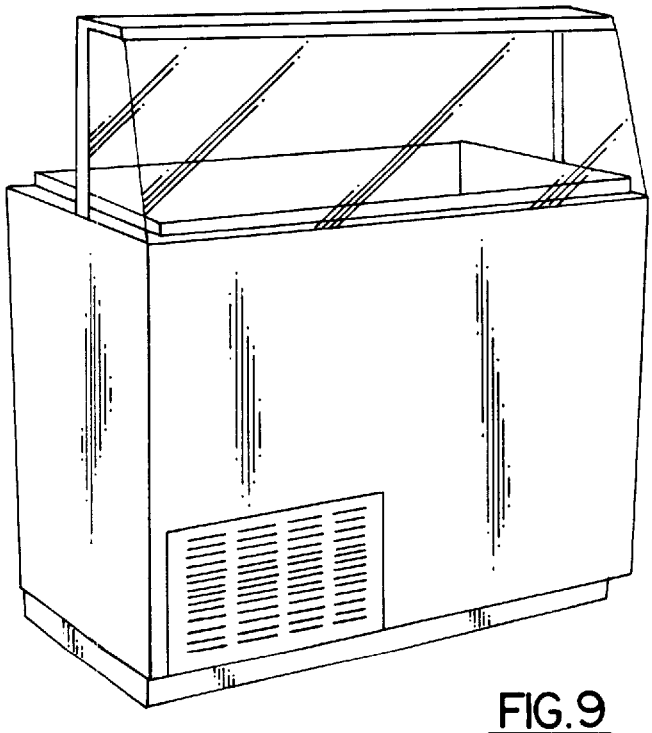
FIG.9 Prior Art
FIG. 9 is a perspective view of a prior art dipping cabinet.

In accordance with one aspect of the present invention, the transparent front wall 34, including its window 35, is extended downwardly toward the product fill line 17, and most advantageously down to the product fill line 17, thereby increasing the customer view area. As depicted in the drawing, to accommodate the downward extension of the transparent front wall 34 of the canopy 30, the front wall 13 of the cabinet base 20 is foreshortened to a height that is lower than the height of the rear wall 15 and side walls 17 of the cabinet base 20. Generally, in the refrigerated cabinet of the present invention, the front wall 13 will be several inches, for example about six inches, shorter than the side walls and rear wall of the cabinet base 20. The lower portion of the front wall 34 of the canopy 30, with its window 35, extends downwardly to meet and seal with the trim member 16 capping the front wall 13 of the cabinet base 20. By extending the front wall 34 and its window 35 downwardly, the view area is increased and children are now able to see the various ice cream flavors within the refrigerated cabinet, as best illustrated in FIG. 5.

The window 35 in the front wall 34 of the canopy 30 may be formed as a single piece, flat or arcuate, of molded, transparent plastic or Plexiglas material. However, more advantageously, the window 35 is a multi-pane thermal window having two or more panes disposed in spaced relationship thereby forming an insulating air space therebetween. Most advantageously, the window 35, whether flat or arcuate, comprises such a thermal window with a pair of spaced glass panes 35' and 35".

Figure 4:
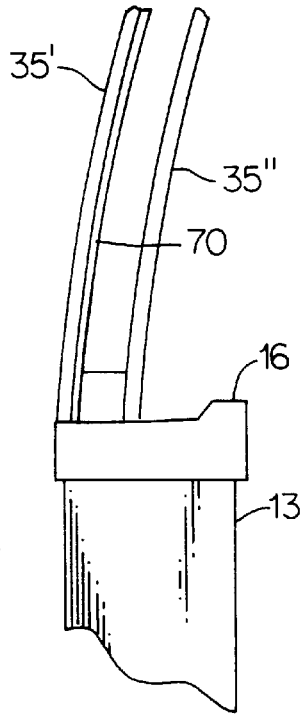
FIG. 4 is an expanded sectional side view of the lower portion of the front wall of the cabinet base of the refrigerated cabinet of FIG. 1.

As the lower portion of the window 35 bordering the refrigerated volume 27 will come in direct contact with moisture entering the cabinet base 20 when the service door is open, it is advantageous to heat this lower portion of the window 35 to prevent frost formation. Frost would obscure the view of the product 50 through the frosted portion of the window 35. According, as illustrated in FIG. 4, an electroconductive coating 70 may be applied to at least the lower portion of one of the panes, for example to the inside surface of the lower portion of outside pane 35'. Busbars (not shown) in contact with the electroconductive coating an connected to a power supply provide a means of supplying electric current across the electroconductive coating. Electrical current is selectively passed through the electroconductive coating to heat the window sufficiently to maintain the window at a temperature above the local dew point thereby precluding frost formation on the inside surface of the inside panel 35" or condensation on the outside surface of the outside panel 35', but avoiding undesireable heating of the product 50 in the refrigerated cabinet 10.

The rear wall 38 of the canopy 30 comprises a transparent service door 40 carried on a framework 42. Although the service door 40 may be made of a transparent plastic material or Plexiglas, as in conventional dipping cabinets, most advantageously, the service door 40 is a panel of flat, tempered glass. Tempered glass is considerably stronger than plastic materials and has greater structural rigidity. Further, tempered galss is not as easily marred, scratched or broken.

Figure 2:
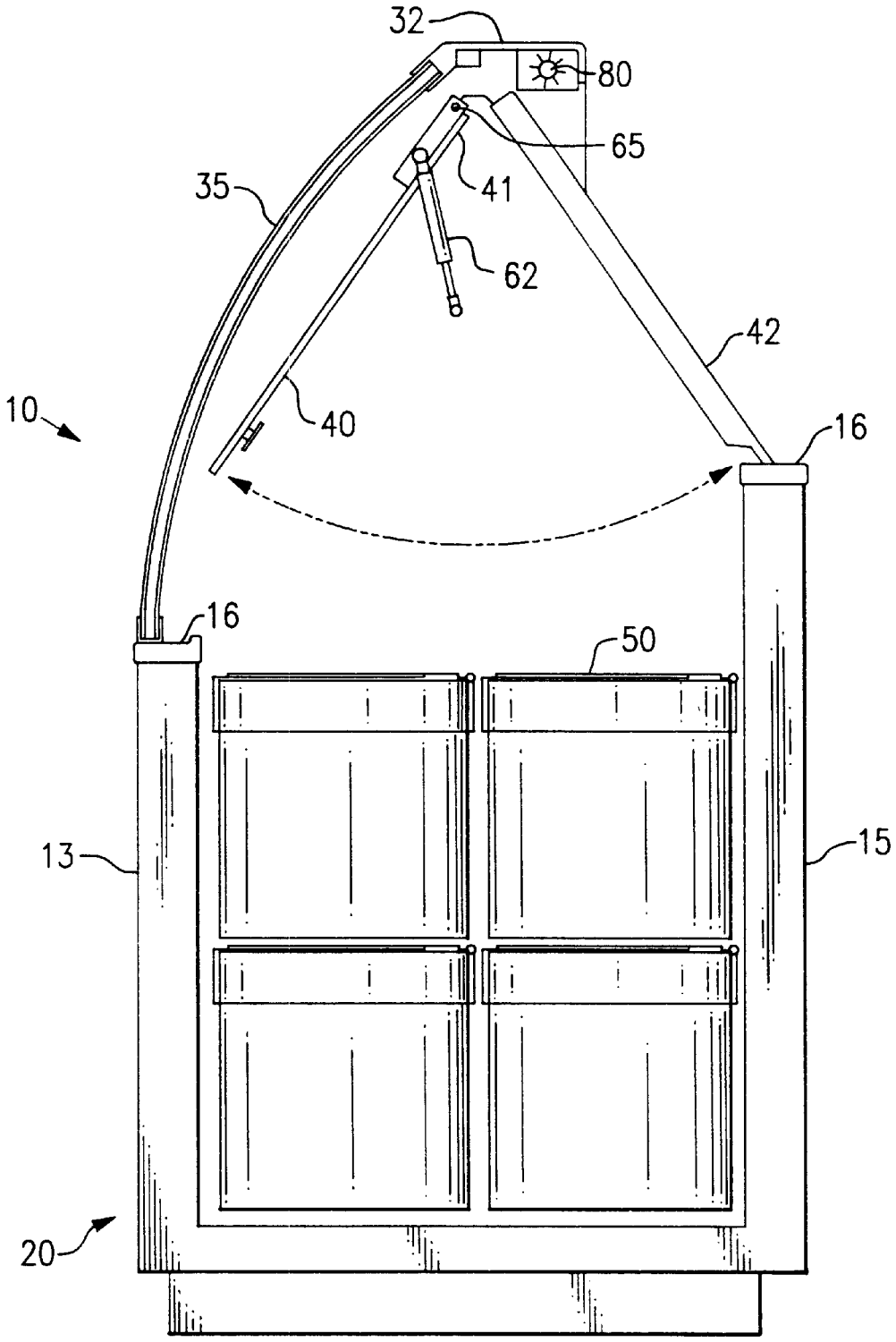
FIG. 2 is a sectional side elevation view of the refrigerated cabinet of the present invention with the service door of the canopy in the open position.
Figure 3:
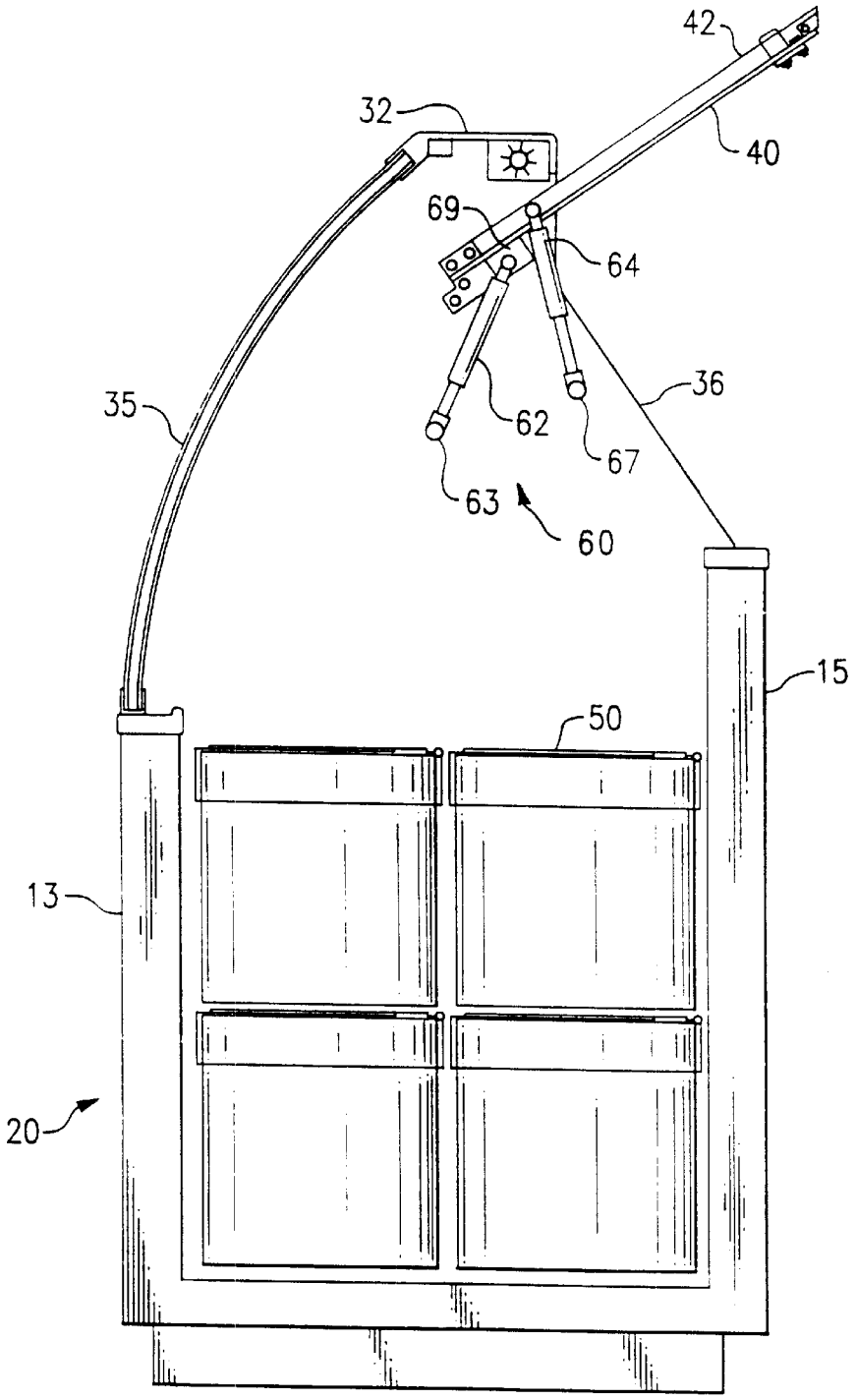
FIG. 3 is a sectional side elevation view of the refrigerated cabinet of the present invention the rear wall of the canopy in the open position.

The service door 40 and the framework 42 are carried on a support system 60 comprising hinges 41 and two sets of paired gas springs 62 and 64 and adapted to pivot about different respective centers of rotation as best seen in FIGS. 1, 2 and 3. Each gas spring 62 connects at its distal end to a hinge 41 mounted to the framework 42 and at its proximal end to a support bracket 63 mounted on the respective side wall 36. The service door 40 pivots about a first center of rotation through a pivot pin 65 in each hinge 41. Each gas spring 64 connects at its distal end to the framework 42 and its proximal end to a support bracket 67 mounted on the side wall 36. The framework 42 pivots about a second center of rotation through the pivot pins 69 supported on the respective side wall 36. A set of support brackets 63 and 67 and pivot pin 69 are provided in each of the side walls 36.

Figure 6:
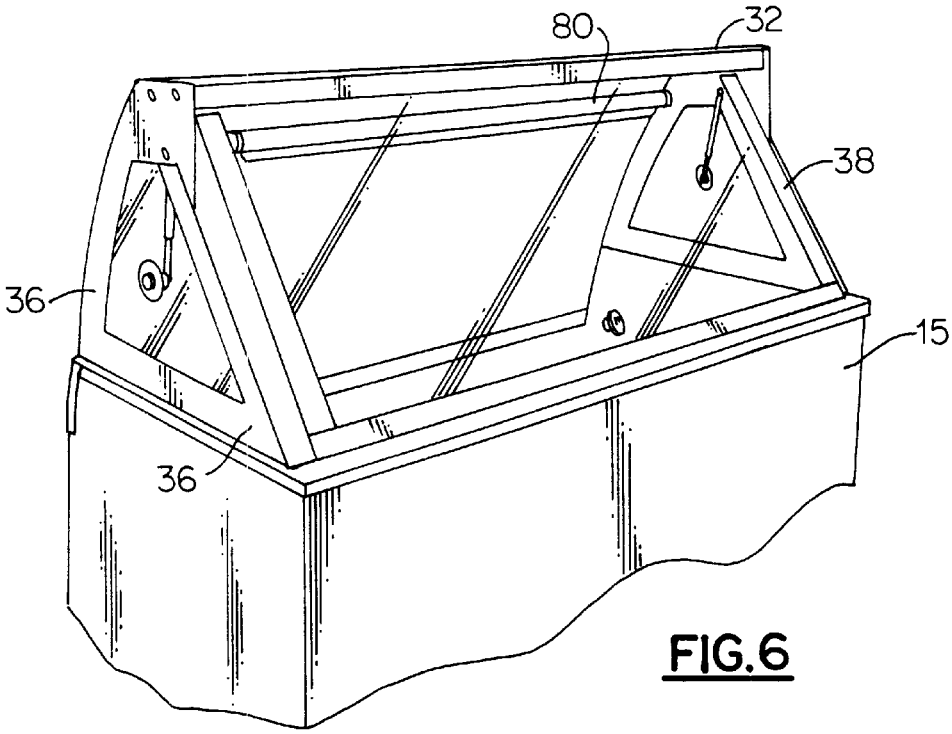
FIG. 6 is a perspective view of the refrigerated cabinet of the present invention taken generally from the rear of the cabinet.

In the closed position, as illustrated in FIGS. 1 and 6, the rear wall 38 is held at a nominal 45 degree angle with its lower end in sealing contact with the trim member 16 on the rear wall 15 of the cabinet base 20 and with its upper end in sealing contact with the top wall 32 of the canopy 30. The sides of the rear wall 38 of the canopy 30 are in sealing contact with the respective side walls 36 of the canopy 30. Most advantageously, the sealing function is accomplished by gaskets carried on one or more of the edges of the rear wall 38, the top wall 32, or the side walls 36. Additionally, in the closed position, the service door 40 is pressed against the framework 42 and held in that position by the action of the gas springs.

A lamp 80, most advantageously a fluorescent light, is mounted to the top wall 32 of the canopy 30 at a position external to the canopy interior when the rear wall is in its closed position as best illustrated in FIG. 6. Conventional dipping cabinets typically have a lamp mounted to the top wall of the canopy but positioned within the cabinet interior. So positioned within the canopy, the heat energy radiated from the lamp is trapped within the refrigerated interior of the cabinet 10, thereby increasing the cooling load on the refrigeration system and potentially warming and softening the ice cream product. Also, high-energy wavelengths from the lamp tend to break down the product chemistry causing discoloration. By positioning the lamp exteriorly of the cabinet 10 in accordance with the present invention, the heat energy form the lamp is dissipated to the environment outside the refrigerated cabinet. Also, the high-energy wavelength light may be reflected by the service door 40, while only the lower energy wavelength light passes through the transparent service door 40 to illuminate the interior of the refrigerated cabinet 10. The tempered glass panel forming the service door 40 in the preferred embodiment may be coated with an appropriate material to enhance blocking of the high-energy wavelength light from entering the refrigerated cabinet. If desired, the tempered glass panel forming the service door 40 may be coated with an electroconductive film whereby electrical current may be applied to the coating to selectively heat the glass panel to prevent fogging from condensation and/or frosting.

Figure 7:
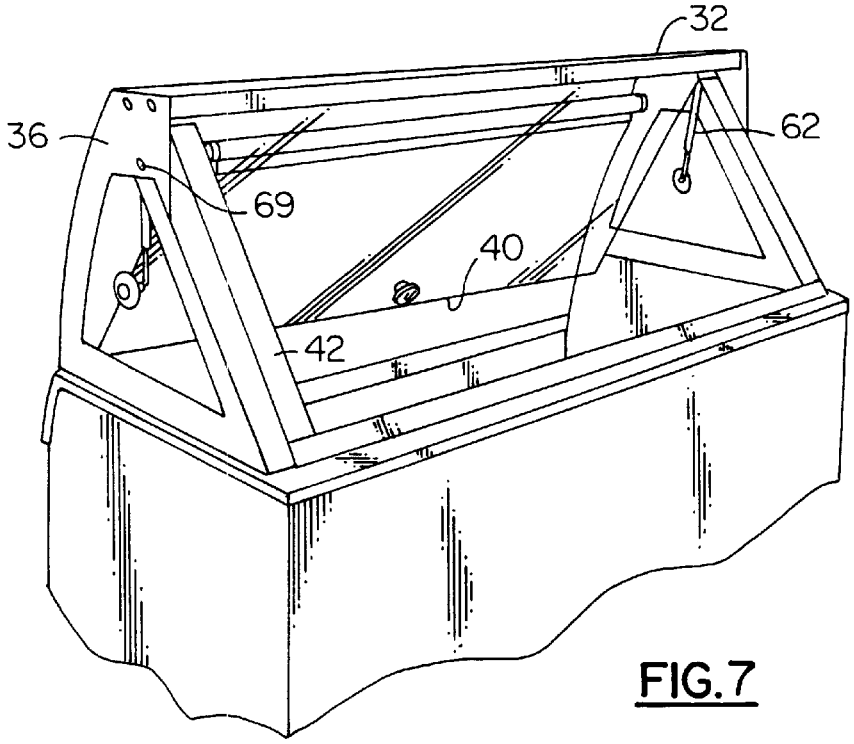
FIG. 7 is a perspective view of the refrigerated cabinet of the present invention taken generally from the rear of the cabinet showing the service door in an open position.

In accordance with the present invention, to access the interior of the refrigerated cabinet 10 for dipping the ice cream product 50, the service attendant merely pushes the service door 40 inward. Pushing downwardly on the lower portion of the service door 40 causes the service door 40 to rotate inwardly about the first center of rotation 63 together with the gas spring hinges 62 which pivot within their respective support brackets 65. The service door 40 rotates forward to rest against one or more stops in its open position, as best illustrated in FIGS. 2 and 7. When opened, the service door 40 affords easy access to the product 50 within the interior of the refrigerated cabinet 10, while not obstructing the customer's view.

Figure 8:
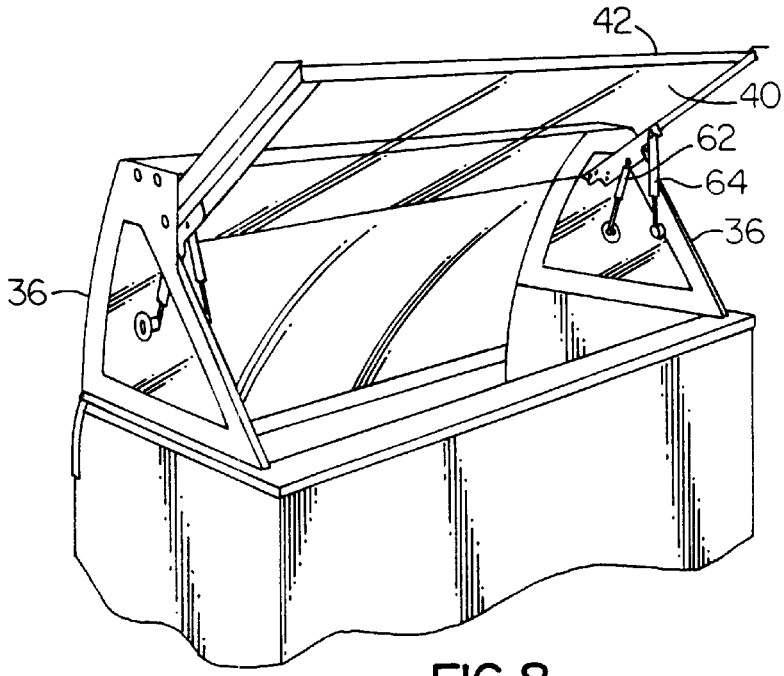
FIG. 8 is a perspective view of the refrigerated cabinet of the present invention taken generally from the rear of the cabinet showing the service door and framework s a Win an open position.

In accordance with a further aspect of the present invention, the service door 40 and framework 42, which together form the rear wall 38 of the canopy 30, upwardly and outwardly, rotates about the second center of rotation 67, thereby facilitating cleaning of the interior of the refrigerated cabinet 10. Lifting the lower portion of the service door 40 causes the service door 40 and framework 42 to pivot together as a single unit through a nominal angle of about ninety degrees to an open position, as best illustrated in FIGS. 3 and 8. The gas spring hinges 64 function to hold the service door 40 and framework 42 in place in the open position and also assist in lifting this unit to the open position. Latches are provided at the lower corners of the service door 40 that are selectively engaged to lock the service door 40 to the framework 42 so that the service door 40 and framework 42 form a unit that may be rotated upwardly and outwardly to access the interior of the cabinet 10 for cleaning and sanitizing. When the latches are disengaged, the service door 40 may be rotated inwardly independently of the framework 42 to provide service access to the product 50.

Various modifications and adaptations of the embodiments of the refrigerated cabinet of the present invention as hereinbefore described may be readily apparent to those skilled in the art that may be made without departure from the spirit and scope of the present invention, the scope of which is defined in the appended claims.

What is claimed is:

1. A refrigerated cabinet comprising:

a cabinet base having a front wall, a back wall and end walls defining an open top compartment having a refrigerated interior for housing a refrigerated product;

a canopy disposed atop said compartment, said canopy having a front wall having a transparent window through which the cabinet interior may be viewed, and a back wall having a transparent service door and a framework about said service door, the service door being hinged to the framework for rotation independently of the framework;

support system operatively interconnecting the framework with at least one of the end walls of the cabinet and independently operatively interconnecting the service door with at least one of the end walls of the cabinet, said support system being actionable in a first manner to rotate said service door inwardly between an open position and a closed position independently of said framework and being actionable in a second manner to rotate said service door and said framework together outwardly as a unit between a closed position and an open position.

2. A refrigerated cabinet comprising:

a cabinet base having a front wall, a back wall and end walls defining an open top compartment having a refrigerated interior for housing a refrigerated product;

a canopy disposed atop said compartment, said canopy having a front wall having a transparent window through which the cabinet interior may be viewed, and a back wall having a transparent service door and a framework about said service door, the service door being hinged to the framework for rotation independently of the framework;

a first gas cylinder operatively interconnecting the service door with one of the end walls of the cabinet for movement inwardly independently of the framework; and a second gas cylinder operatively interconnecting the framework with one of the end walls of the cabinet for movement of the framework and the service door together outwardly between a closed position and an open position.

* * * * *